US005439111A

United States Patent [19]

Broskow et al.

[11] Patent Number: 5,439,111

[45] Date of Patent: Aug. 8, 1995

[54] PACKAGE COMPRISING CONTAINERS IN UNITIZED UPPER AND LOWER TIERS WITH FOLDED DIVIDER

[75] Inventors: James A. Broskow, Buffalo Grove; William N. Weaver, Northbrook; Victor G. DiVietro, Naperville, all of Ill.

[73] Assignee: Illinois Tool Works Inc., Glenview, Ill.

[21] Appl. No.: 238,422

[22] Filed: May 5, 1994

[51] Int. Cl.[6] ..... B65D 75/00

[52] U.S. Cl. ..... 206/430; 206/427; 206/150

[58] Field of Search ..... 206/150, 151, 427, 429, 206/430

[56] References Cited

U.S. PATENT DOCUMENTS

| | | | |
|---|---|---|---|
| 2,996,180 | 8/1961 | Bruce | 206/430 |
| 3,305,085 | 2/1967 | Rossi | 206/150 |
| 3,822,012 | 7/1974 | Weaver | 206/151 |
| 3,923,155 | 12/1975 | Tanzer | 206/427 |
| 4,191,290 | 3/1980 | Suffern | 206/150 |
| 4,403,689 | 9/1983 | Wood | 206/427 |
| 4,465,180 | 8/1984 | Klygis | 206/151 |
| 4,756,419 | 7/1988 | Le Bras | 206/430 |
| 4,930,633 | 6/1990 | Gloyer | 206/427 |
| 4,974,726 | 12/1990 | Klygis et al. | 206/158 |
| 5,246,113 | 9/1993 | Schuster | 206/430 |

FOREIGN PATENT DOCUMENTS

| | | | |
|---|---|---|---|
| 1319902 | 6/1973 | United Kingdom | 206/427 |
| 9012742 | 11/1990 | WIPO | 206/150 |

*Primary Examiner*—David T. Fidei

*Attorney, Agent, or Firm*—Schwartz & Weinrieb

[57] ABSTRACT

A novel, unitized package has an upper tier and a lower tier of containers, wherein each tier comprises substantially identical containers, such as beverage cans of a type having a chime at an upper end, in arranged a substantially rectangular array, and a carrier made from a single sheet of resilient polymeric material, such as low density polyethylene. A unitizing sheet made from a paperboard material is folded so as to form a cover panel, which covers the upper ends of the containers of the upper tier, two lateral panels, which extend downwardly from the cover panel, along and below the containers of the upper tier, and along the containers of the lower tier, and a divider integral with one of the lateral panels. The cover panel of the covering sheet has slits receiving portions of the chimes of the containers of the upper tier. The divider is folded from the first lateral panel toward the second lateral panel, so as to extend between the lower ends of the containers of the upper tier and the upper ends of the containers of the upper tier. Each lateral panel is attached adhesively to at least one of the band segments of each carrier and the second lateral panel is attached adhesively to a flap folded from the divider so as to unitize the upper and lower tiers.

10 Claims, 1 Drawing Sheet

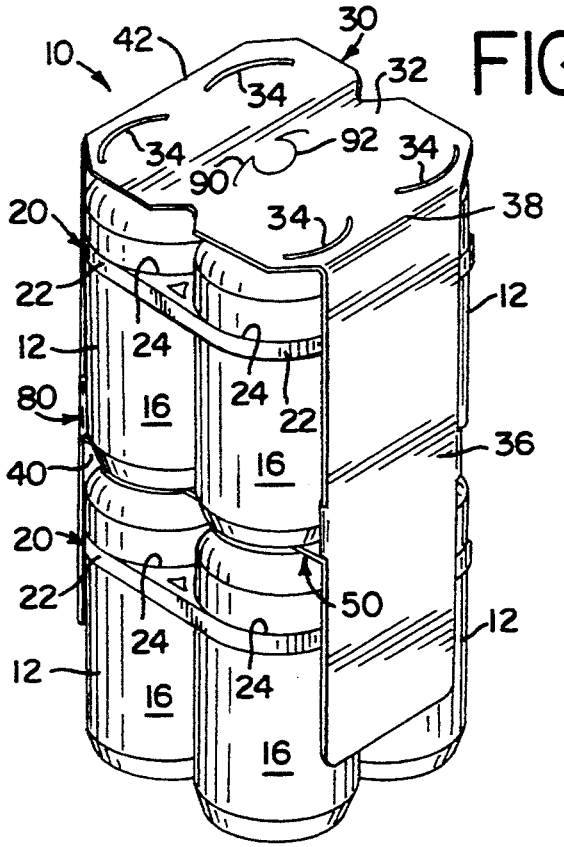
FIG. 1
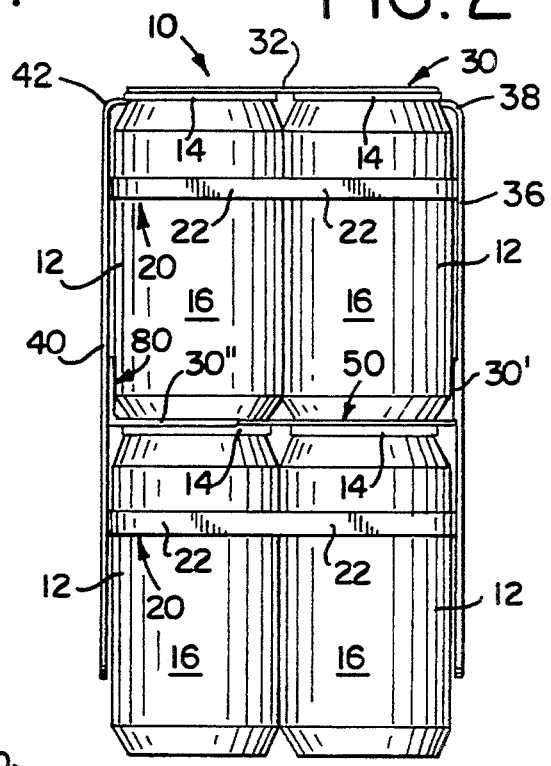
FIG. 2
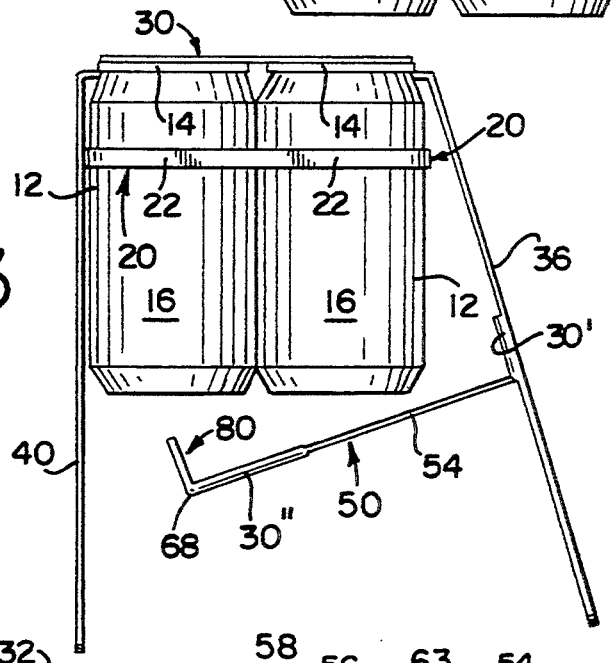
FIG. 3
FIG. 4
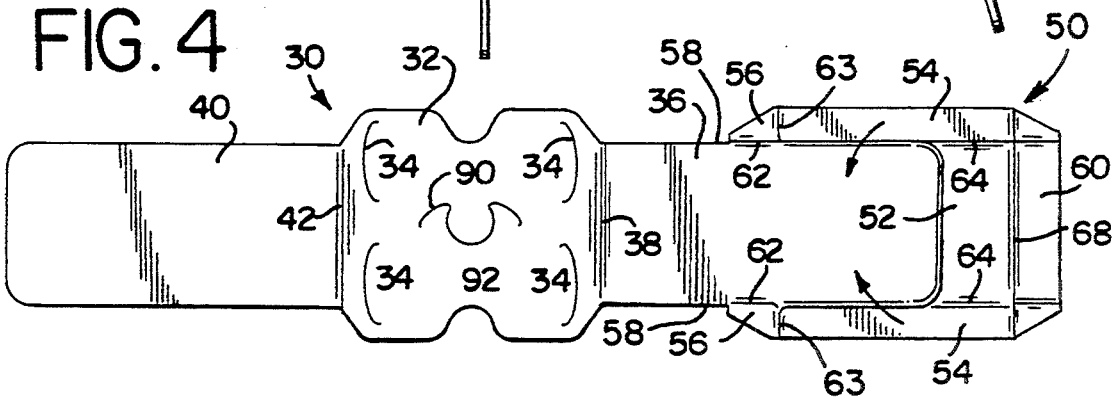

PACKAGE COMPRISING CONTAINERS IN UNITIZED UPPER AND LOWER TIERS WITH FOLDED DIVIDER

TECHNICAL FIELD OF THE INVENTION

This invention pertains to a novel package comprising substantially identical containers, such as beverage cans of a type having a chime at an upper end, in unitized upper and lower tiers. A unitizing sheet provides a divider folded between the containers of the upper tier and the containers of the lower tier. The unitizing sheet also provides expansive surfaces for pricing, barcoding, and other labelling of the novel package.

BACKGROUND OF THE INVENTION

Commonly, beverage cans of the type noted above are marketed in packages comprising four, six, eight, or twelve cans arranged in substantially rectangular arrays and retained in machine-applied carriers made from single sheets of resilient polymeric material, such as low density polyethylene. The carriers are made, as by die-cutting, so as to have band segments defining container-receiving apertures.

As exemplified in Klygis et al. U.S. Pat. No. 4,974,726, it is known to cover such cans with a separate sheet, which is clipped onto the cans to enhance such a package. A package of related interest is disclosed in Suffern U.S. Pat. No. 4,191,290.

Since shelf space in a modern supermarket must be strictly allocated among a great diversity of different products, it has been proposed to stack one such package comprising four or six cans on a like package and to sell the stacked packages as a unitized package.

When beverage cans are stacked on one another, one concern that must be addressed is that the lower ends of the upper cans tend to interlock with the upper ends of the lower cans, particularly if pull tabs are provided on the upper ends of the respective cans.

A need has arisen, to which this invention is addressed, for an effective way to unitize such stacked packages.

SUMMARY OF THE INVENTION

This invention provides a novel package comprising substantially identical containers, such as beverage cans of the aforenoted type having a chime at an upper end, in an upper tier and a lower tier. Each tier comprises such containers in a substantially rectangular array, such as a substantially square array of four containers.

Each tier comprises a carrier made from a single sheet of resilient polymeric material, such as low density polyethylene, so as to have band segments defining container-receiving apertures. The carrier is applied to the containers of such tier so that the containers thereof are received by the container-receiving apertures and so that the band segments embrace the side walls of the containers of such tier.

The novel package comprises a separate sheet folded so as to form a cover panel, a first lateral panel, a second lateral panel, and a divider. The cover panel covers at least a substantial part of the upper ends of at least some of the containers of the upper tier. Each lateral panel extends downwardly from the cover panel, along and below adjacent ones of the containers of the upper tier, and along adjacent ones of the containers of the lower tier. The divider is integral with the unitizing sheet and is folded from one of the aforesaid panels, preferably from the first lateral panel toward the second lateral panel, so as to extend between the lower ends of the containers of the upper tier and the upper ends of the containers of the lower tier.

Each lateral panel is affixed to at least one of the band segments of the carrier of the lower tier so as to unitize the upper and lower tiers. Preferably, the divider has a distal portion folded so as to form a flap extending along the second lateral panel. Preferably, moreover, the second lateral panel is affixed to the flap.

As and where noted above, it is preferred for the lateral panels to be adhesively affixed. If each container has a chime at its upper end, it is preferred for the cover panel to have slits receiving portions of the chimes of at least some of the containers of the upper tier.

In a preferred embodiment, the divider has a cross portion and two edge portions, through which the divider is joined to the first lateral panel. Each edge portion is joined to the first lateral panel at an integral ear extending from a respective one of two opposite edges of the first lateral panel. Each edge portion is folded over the first lateral panel and over the cross portion, along a folding line aligned with the same one of the opposite edges, so as to form double thicknesses of the unitizing sheet where folded thereover before the divider is folded from the first lateral panel toward the second lateral panel. The divider is folded from the first lateral portion, toward the second lateral portion, along folding lines aligned with each other where the edge portions are joined to the integral ears. The divider has a distal portion folded so as to form a flap extending vertically from the cross and edge portions, after the edge portions have been folded thereover, so as to extend vertically from the cross and edge portions, along the second lateral panel. Further, as noted above, the lateral panel is affixed to the distal portion.

BRIEF DESCRIPTION OF THE DRAWINGS

These and other objects, features, and advantages of this invention will be evident from the following description of a preferred embodiment of this invention with reference to the accompanying drawings, in which like reference characters designate like or corresponding parts throughout the several views, and wherein FIG. 1 is a perspective view of a unitized package embodying this invention and comprising four containers in each of two tiers, a carrier applied to the containers in each tier, and a unitizing sheet.

FIG. 2 is an end view of the unitized package, as shown in FIG. 1.

FIG. 3 is an end view of the upper tier and the unitizing sheet, in a partly assembled condition.

FIG. 4, on a smaller scale, is a plan view of the unitizing sheet, as unfolded and flattened.

DETAILED DESCRIPTION OF PREFERRED EMBODIMENT

As shown, a unitized package 10 comprising four containers 12 in a substantially square array, in an upper tier, and four containers 12 in a substantially square array, in a lower tier, constitutes a preferred embodiment of this invention. The containers 12 are substantially identical beverage cans of the aforenoted type, each having a chime 14 at an upper end and each having a side wall 16, which is substantially cylindrical.

Each tier comprises a carrier 20 made, as by die cutting, from a single sheet of resilient polymeric material, such as low density polyethylene, so as to have band segments 22 defining container-receiving apertures 24. Any of various known carriers made from carrier stock available commercially from ITW Hi-Cone (a division of Illinois Tools Works Inc.) of Itasca, Ill., may be suitably used as the carrier 20 of each tier.

Each carrier 20 is applied to the containers 12 of the tier comprising such carrier 20, as by known machinery, so that the container-receiving apertures 24 of such carrier 20 receive the respective containers 12 and so that the band segments 22 embrace the side walls 16 of the respective containers 12. Suitable carrier-applying machinery is available commercially from ITW Hi-Cone, supra.

The unitized package 10 comprises a unitizing sheet 30 made, as by die cutting, from a blank of a paperboard material and folded so as to form a cover panel 32 having four curved slits 34, a first lateral panel 36 joined to the cover panel 32 along a folding line 38, a second lateral panel 40 joined to the cover panel 32 along a folding line 42, which is parallel to the folding line 38, and a divider 50 joined to the first lateral panel 36 in a manner to be later described. The unitizing sheet 30 is shown, as unfolded and flattened, in FIG. 4.

The cover panel 32 is configured so as to cover substantially all of the upper ends of the containers 12 of the upper tier, as shown in FIG. 1, when the package 10 is assembled. Each of the curved slits 34 is configured to receive a portion of the chime 14 of one of the containers 12 of the upper tier.

Each of the lateral panels 36, 40, extends downwardly from the cover panel 32, along and below two adjacent containers 12 of the upper tier, and along two adjacent containers 12 of the lower tier, at least as far as the carrier 20 of the lower tier. Preferably, as shown, the lateral panels 36, 40, extend downwardly for a substantial distance beyond the carrier 20 of the lower tier.

The divider 50 has a cross portion 52, which is disposed beyond the first lateral panel 36 in the unfolded, flattened sheet 30, two edge portions 54, each of which extends from an integral ear 56 extending from one of two opposite edges 58 of the first lateral panel 36, and a distal portion 60, which extends from the cross portion 52 and from the edge portions.

As suggested by curved arrows in FIG. 4, each edge portion 54 and the integral ear 56 from which such edge portion 54 extends are folded over the first lateral panel 36, along a folding line 62 aligned with the same one of the opposite edges 58, so as to form a double thickness 30′ of the unitizing sheet 30 where such edge portion 54 is folded over the first lateral panel 36, and over the cross portion 52, so as to form a double thickness 30″ of the unitizing sheet 30 where such edge portion 54 is folded over the cross portion 52.

After each edge portion 54 and the integral ear 56 from which such edge portion 54 extends have been folded over the first lateral panel 36 and the cross portion 52, the divider 50 is folded from the first lateral panel 36, along folding lines 63 where the edge portions 54 are joined to the integral ears 56, so as to extend below the lower ends of the containers 12 of the upper tier.

The distal portion 60 is folded from the cross portion 52 and from the edge portions 54, along a folding line 68 at the double thicknesses of the unitizing sheet 30 where the edge portions 54 are folded over the cross portion 52 and at a single thickness of the unitizing sheet 30 between the edges portion 54 where folded thereover, so as to form a flap 80 extending vertically from the cross portion 52 and from the edge portions 54, along the second lateral panel 40, when the divider 50 is folded between the containers 12 of the upper tier and the containers 12 of the lower tier. Preferably, as shown in FIG. 3, the distal portion 60 is folded along the folding line 68 before the divider 50 is folded under the lower ends of the containers 12 of the upper tier.

Preferably, as shown in FIGS. 1, 2, and 3, the distal portion 60 is folded so as to cause the flap 80 to extend upwardly from the cross portion 52 and from the edge portions 54, between the second lateral panel 40 and two adjacent containers 12 of the upper tier. However, the distal portion 60 may be alternatively folded so as to cause the flap 80 to extend downwardly therefrom, between the second lateral panel 40 and two adjacent containers 12 of the lower tier.

The unitizing sheet 30 is applied to the containers 12 of the upper tier so that the cover panel 32 covers substantially all of the upper ends of the containers 12 of the upper tier, and so that each of the curved slits 34 receives a portion of the chime 14 of one of the containers 12 of the upper tier.

The unitizing sheet 30 is folded so that the lateral panels 36, 40, extend downwardly, so that the divider 50 extends between the containers 12 of the upper tier and the containers 12 of the lower tier, and so that the flap 80 extends vertically between the second lateral panel 40 and two adjacent containers 12 of one of the upper and lower tiers. Preferably, as described above, the unitizing sheet 30 is folded so that the flap 80 extends upwardly between the second lateral panel 40 and two adjacent containers 12 of the upper tier.

Each of the lateral panels 36, 40, is affixed to the carrier 20 of the upper tier, at the band segments 22 embracing outer portions of the side walls 16 of two adjacent containers 12 of the upper tier, and to the carrier 20 of the lower tier, at the band segments 22 embracing outer portions of the side walls 16 of two adjacent containers 12 of the lower tier. Moreover, where the flap 80 extends vertically between the second lateral panel 40 and two adjacent containers 12, the second lateral portion 40 is affixed to the flap 80.

As shown in FIGS. 1 and 4, the cover panel 32 of the unitizing sheet 30 has a slit 90 defining a tab 92, which can be bent downwardly into a space among the containers 12 of the upper tier so as to accommodate one or more fingers of a user carrying the package 10.

Advantageously, the divider 50 not only helps to unitize the upper and lower tiers but also divides the containers 12 of the respective tiers, so as to offset any tendencies of the lower ends of the containers 12 of the upper tier to interlock with the upper ends of the containers 12 of the lower tier, even if pull tabs (not shown) are provided at the upper ends of the respective containers 12.

Advantageously, the unitizing sheet 30 also provides expansive surfaces on the cover panel 32 and the lateral panels 36, 40, for pricing, barcoding, and other labelling of the unitized package 10.

Although each tier has four containers 12 in the preferred embodiment described above, each tier may have a different number of such containers 12, such as, for example, six containers 12.

Although it is preferred for the unitizing sheet 30 to be adhesively affixed as and where noted above, the unitizing sheet 30 may be heat-sealed if suitable coatings or suitable materials are employed.

Various other modifications may be made in the preferred embodiment described above without departing from the scope and spirit of this invention.

It is therefore to be understood that within the scope of the appended claims, the present invention may be practiced otherwise than as specifically described herein.

We claim:

1. A unitized package, comprising:

a plurality of substantially identical containers having upper and lower ends and side walls, and arranged in an upper tier and a lower tier; each tier comprising a plurality of such containers disposed in a substantially rectangular array, and a carrier comprising a single sheet of resilient polymeric material so as to have band segments defining container-receiving apertures with said carrier being applied to said containers of said tier so that said containers are received by said container-receiving apertures and so that said band segments embrace said side walls of said containers of said tier;

a unitizing sheet folded so as to form a cover panel, a first lateral panel, a second lateral panel, and a divider; said cover panel covering at least a substantial part of said upper ends of at least some of said containers of said upper tier; each lateral panel extending downwardly from said cover panel along and below adjacent ones of said containers of said upper tier, and along adjacent ones of said containers of said lower tier at least as far down as said carrier of said lower tier; said divider being integrally connected at one end thereof to one of said first and second lateral panels of said unitizing sheet; and means defined between said divider and said one of said first and second lateral panels for permitting said divider to be folded with respect to said one of said first and second lateral panels and extend from said one of said first and second lateral panels toward a second one of said first and second lateral panels and be interposed between said lower ends of said containers of said upper tier and said upper ends of said containers of said lower tier; and means for attaching each one of said first and second lateral panels to at least one of said band segments of said carrier of said lower tier so as to unitize said upper and lower tiers of said package.

2. The package of claim 1 wherein the divider has a distal portion folded so as to extend vertically along the second lateral panel, which is attached to the distal portion.

3. The package of claim 1 wherein the divider has a cross portion and two edge portions, the divider being joined to the first lateral portion through the edge portions.

4. The package of claim 3 wherein the divider has a distal portion folded from the cross and edge portions so as to extend vertically from the cross and edge portions, along the second lateral panel, which is attached to the distal portion.

5. The package of claim 3 wherein each edge portion of the divider is joined to the first lateral panel at an integral ear extending from a respective one of two opposite edges of the first lateral panel and being folded over the first lateral panel, with said edge portion, along a folding line aligned with said respective one of the opposite edges, so as to form a double thickness of the unitizing sheet wherein the integral ear is folded thereover before the divider is folded from the first lateral panel toward the second lateral panel, and the divider is folded from the first lateral panel toward the second lateral panel along folding lines which are aligned with each other at positions where the edge portions are joined to the integral ears.

6. The package of claim 5 wherein the divider has a distal portion folded from the cross and edge portions, after the edge portions have been folded over said first lateral portion, the distal portion being folded so as to extend vertically, from the cross and edge portions, along the second lateral panels, which is attached to the distal portion.

7. The package of claim 4 wherein the first lateral panel is adhesively attached to at least one of the band segments of the carrier of the upper tier and to at least one of the band segments of the carrier of the lower tier and wherein the second lateral panel is adhesively attached to at least one of the band segments of the carrier of the upper tier, to the distal portion of the divider, and to at least one of the band segments of the carrier of the lower tier.

8. The package of claim 7 wherein each container has a chime at an upper end of said container and wherein the cover panel of the unitizing sheet has slits for receiving portions of the chimes of at least some of the containers of the upper tier.

9. The package as set forth in claim 1, wherein:

said carriers of said upper and lower tiers comprise polyethylene.

10. The package as set forth in claim 1, wherein:

said unitizing sheet comprises paperboard.

* * * * *